US009605561B2

(12) United States Patent
Smith et al.

(10) Patent No.: US 9,605,561 B2
(45) Date of Patent: Mar. 28, 2017

(54) MODULAR TURBOMACHINE INLET ASSEMBLY AND RELATED INLET TRANSITION SECTION

(71) Applicant: General Electric Company, Schenectady, NY (US)

(72) Inventors: Sean Allen Smith, Guilderland, NY (US); Michael Christopher Jones, Niskayuna, NY (US); Erik Eduardo Lopez Partida, Clifton Park, NY (US); Daniel Ross Predmore, Ballston Lake, NY (US)

(73) Assignee: General Electric Company, Schenectady, NY (US)

( * ) Notice: Subject to any disclaimer, the term of this patent is extended or adjusted under 35 U.S.C. 154(b) by 1040 days.

(21) Appl. No.: 13/801,425

(22) Filed: Mar. 13, 2013

(65) Prior Publication Data

US 2014/0271155 A1 Sep. 18, 2014

(51) Int. Cl.

| | |
|---|---|
| ***F01D 9/02*** | (2006.01) |
| ***F23R 3/00*** | (2006.01) |
| ***F23R 3/60*** | (2006.01) |
| ***F01D 25/24*** | (2006.01) |
| ***F01D 25/26*** | (2006.01) |
| ***F01D 9/06*** | (2006.01) |
| ***F01D 9/04*** | (2006.01) |

(52) U.S. Cl.

CPC ..... *F01D 25/24* (2013.01); *F01D 9/023* (2013.01); *F01D 9/048* (2013.01); *F01D 9/06* (2013.01); *F01D 9/065* (2013.01); *F01D 25/246* (2013.01); *F01D 25/26* (2013.01); *F23R 3/002* (2013.01); *F23R 3/60* (2013.01); *F05D 2220/31* (2013.01); *F05D 2230/51* (2013.01); *F05D 2230/61* (2013.01); *F05D 2240/14* (2013.01)

(58) Field of Classification Search

CPC ..... F01D 9/023; F01D 25/246; F01D 25/26; F01D 25/24; F01D 9/048; F01D 9/06; F01D 9/065; F23R 3/002; F23R 3/60; F05D 2240/14; F05D 2220/31; F05D 2230/51; F05D 2230/61

See application file for complete search history.

(56) References Cited

U.S. PATENT DOCUMENTS

| | | | |
|---|---|---|---|
| 4,863,341 | A | 9/1989 | Groenendaal |
| 6,629,819 | B1 | 10/2003 | Brown et al. |
| 2002/0023575 | A1 | 2/2002 | Gatley, Jr. |
| 2008/0213091 | A1 | 9/2008 | Lageder et al. |
| 2012/0171010 | A1 | 7/2012 | Chevrette |
| 2012/0282083 | A1 | 11/2012 | Gonoor et al. |

OTHER PUBLICATIONS

Office Action for U.S. Appl. No. 13/801,371, dated Jul. 15, 2016, 15 pages.

*Primary Examiner* — Nicholas J Weiss
*Assistant Examiner* — Wesley Harris
(74) *Attorney, Agent, or Firm* — Ernest G. Cusick; Hoffman Warnick LLC

(57) ABSTRACT

An inlet transition section and an inlet bowl entry can be designed to reduce a number of turbomachine casing designs. Using relationships between flow properties, distances between elements, crossover/supply pipe diameter, ideal cross sectional area, aspect ratio, and inlet bowl entry size, a transition from circular cross section to substantially polygonal cross section can be made while enabling adoption of a single size of substantially polygonal inlet bowl entry for a plurality of turbine sizes and/or crossover/supply pipe sizes with minimal losses.

15 Claims, 6 Drawing Sheets

MODULAR TURBOMACHINE INLET ASSEMBLY AND RELATED INLET TRANSITION SECTION

BACKGROUND OF THE INVENTION

The disclosure relates generally to turbomachinery, such as steam turbines, and more particularly, to inlet assemblies for turbomachinery.

A turbomachine can receive a supply of fluid from a supply conduit via an inlet assembly. The inlet assembly can guide the flow from the supply conduit to a rotor of the turbomachine, and can reshape and redirect the flow. An inlet transition section of the inlet assembly can guide the flow to an inlet bowl of the assembly. The inlet bowl can redirect the flow, such as by turning it through an angle to be received by the rotor. Typically, the inlet bowl will be connected to the inlet transition section along an edge of the inlet bowl, which results in a polygonal or substantially polygonal connection. The inlet transition section can reshape and direct the flow from the circular cross section pipe to the polygonal or substantially polygonal opening to minimize aerodynamic and/or other losses through the transition. However, typically the inlet assembly is specific to a given supply conduit, or at least to a specific turbomachine model, resulting in a large number of inlet assembly designs.

BRIEF DESCRIPTION OF THE INVENTION

Embodiments of the invention disclosed herein may take the form of a turbomachine inlet transition section that can include a substantially circular entry and a reshaping portion beginning at the substantially circular entry. The reshaping portion can end in an intermediate region of the inlet transition section having a first substantially polygonal cross section. A cross section of the reshaping portion can change from substantially circular at the entry to the first substantially polygonal cross section at the intermediate region while maintaining substantially constant cross sectional area throughout the reshaping portion. The inlet transition section can also include a prismoidal portion beginning at the intermediate region and ending at an inlet transition section exit having a second substantially polygonal cross section that is of the same type of polygon as the first substantially polygonal cross section while being of substantially different dimension.

Another embodiment can include a modular turbomachine inlet assembly system including a first plurality of inlet transition sections having substantially identical exits of a first size. Each inlet transition section can include an entry, and the entries of the first plurality of inlet transition sections can include at least two different sizes. Each inlet transition section can additionally include a reshaping portion that is a geometric scale of each other reshaping portion of the first plurality of inlet transition sections. The inlet assembly system can also include at least one inlet bowl having an entry of the first size configured for connection to an exit of an inlet transition section of the first plurality of inlet transition sections.

A further embodiment can include a modular turbomachine inlet assembly system having at least two inlet transition sections. Each inlet transition section can include a respective substantially circular entry and a respective substantially polygonal exit. The at least two inlet transition sections can include entries of at least two different diameters, while the substantially polygonal exits can have substantially identical dimensions, a first angle between each respective entry and a respective wall of each respective inlet transition section being substantially equal in all of the at least two inlet transition sections. The system can also include at least one inlet bowl having a substantially polygonal entry of substantially identical dimension to the substantially polygonal exits of the at least two inlet transition sections. Each inlet bowl substantially polygonal entry can correspond to and be configured for attachment to an exit of one of the at least two inlet transition sections.

Other aspects of the invention provide methods of making embodiments of the invention disclosed herein, as well as variants of the apparatus, which include and/or implement some or all of the actions and/or features described herein. The illustrative aspects of the invention are designed to solve one or more of the problems herein described and/or one or more other problems not discussed.

BRIEF DESCRIPTION OF THE DRAWING

These and other features of the disclosure will be more readily understood from the following detailed description of the various aspects of the invention taken in conjunction with the accompanying drawings that depict various aspects of the invention.

It is noted that the drawings may not be to scale. The drawings are intended to depict only typical aspects of the invention, and therefore should not be considered as limiting the scope of the invention. In the drawings, like numbering represents like elements between the drawings.

The detailed description explains embodiments of the invention, together with advantages and features, by way of example with reference to the drawings.

DETAILED DESCRIPTION OF THE INVENTION

Figure 1:
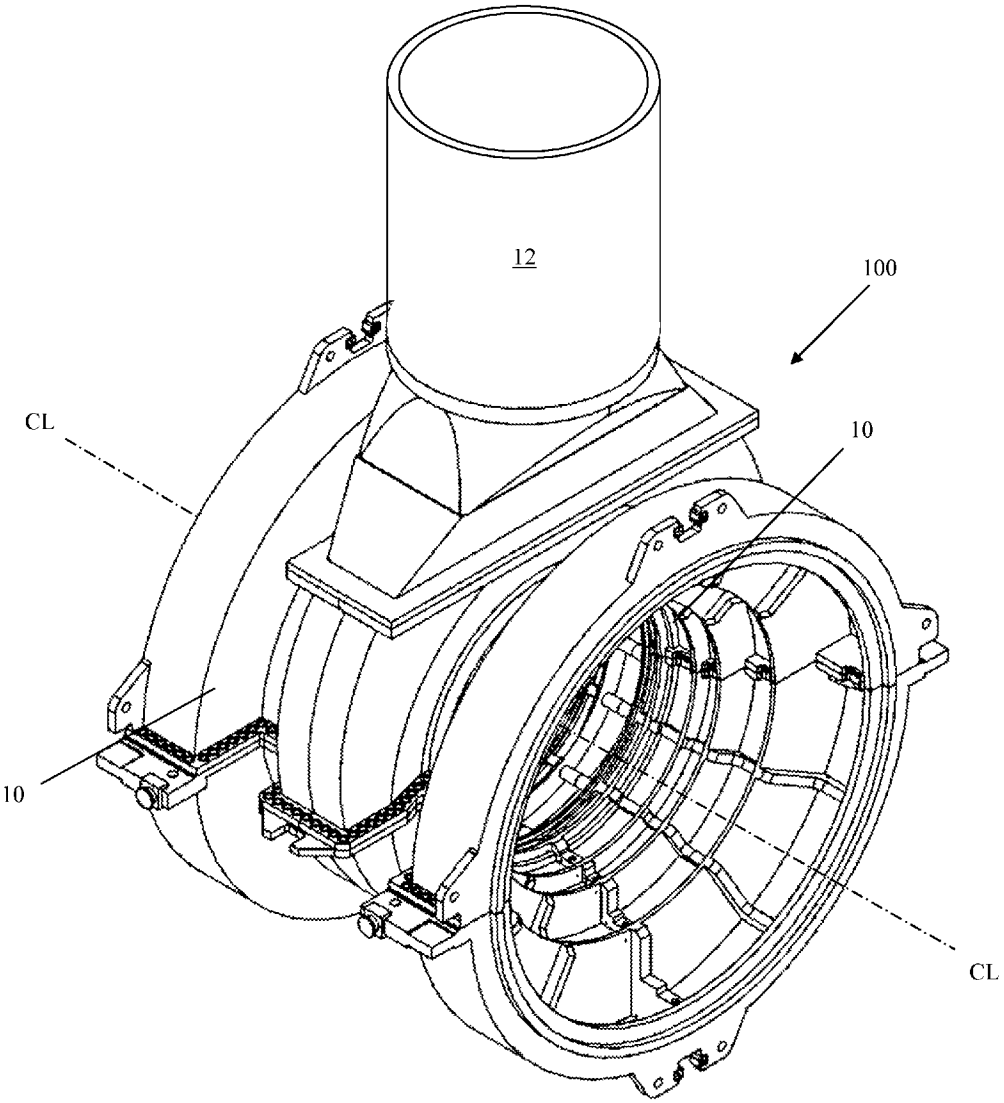
FIG. 1 shows a schematic elevation diagram of a turbomachine including an inlet assembly according to embodiments of the invention disclosed herein.
Figure 2:
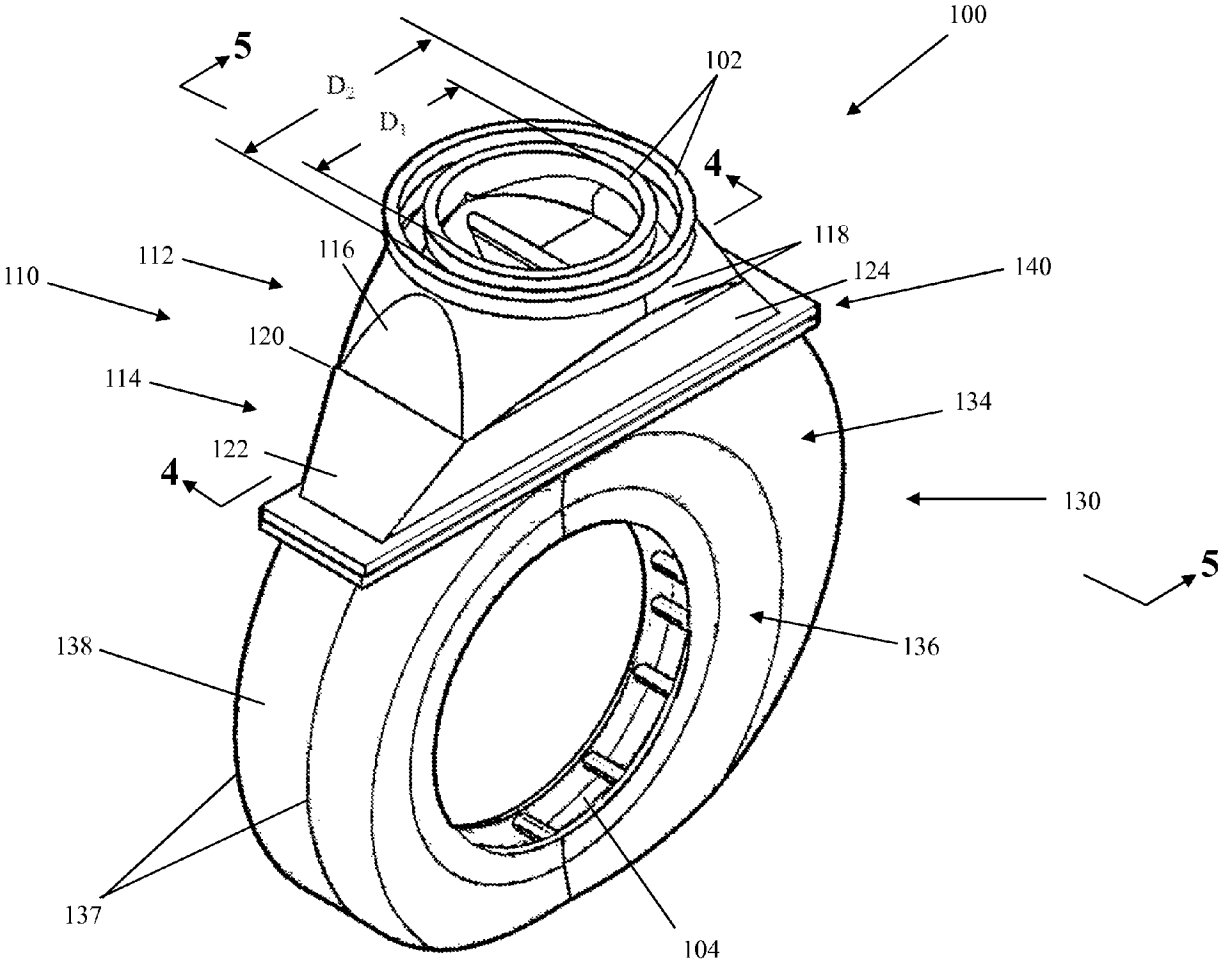
FIG. 2 shows a schematic elevation diagram of an example of an inlet assembly according to embodiments of the invention disclosed herein.

With reference to FIG. 1, a turbomachine can include one or more casings 10 with which an inlet assembly 100 according to embodiments may be used. Inlet assembly 100 can take fluid from a supply conduit 12, reshape and/or scale the flow, and redirect the flow into one or more turbomachine casings 10. Turning to FIG. 2, inlet assembly 100 can include an entry 102 configured to be connected to supply conduit 12 and at least one exit 104 configured to transfer fluid to a respective turbomachine casing 10. Entry 102 can be part of and/or included in an inlet transition section 110, and exit(s) 104 can be part of and/or included in an inlet bowl 130. Flow can be redirected, for example, along a centerline CL of turbomachine casing 10 in embodiments, which can also be a longitudinal axis of inlet bowl 130 and/or turbomachine casing 10.

Turning now to FIG. 2, inlet transition section 110 can reshape and scale a flow passing from entry 102 to inlet bowl 130, such as with a reshaping portion 112 and a prismoidal portion 114, respectively. Entry 102 can have a diameter D, and two sizes of entry 102 are shown in FIG. 2 to illustrate aspects of the invention. It should be noted, however, that only one entry 102 would be used in practice, so that, in the example shown, entry 102 would have either smaller diameter $D_1$ or larger diameter $D_2$, but not two at the same time.

Reshaping portion 112 can include end walls 116 and a plurality of side walls 118, which can be planar and/or curved as may be suitable and/or desired. Reshaping portion 112 can thus gradually change the cross section of inlet transition section 110 from a circle at entry 102 to a polygon at an intermediate region 120 between reshaping portion 112 and prismoidal portion 114, which can also be viewed as a boundary. In embodiments, a cross sectional area of reshaping portion 112 is substantially constant, which can reduce and/or substantially minimize losses through reshaping portion 112. Prismoidal portion 114, itself including end walls 122 and side walls 124, can extend between intermediate region 120 and an exit 126 of inlet transition section 110. In embodiments, the cross sections at intermediate region 120 and exit 126 can be of the same type of polygon, but of different dimension(s). In addition, changing dimensions of the polygonal cross section can be done gradually so as to minimize losses.

Figure 3:
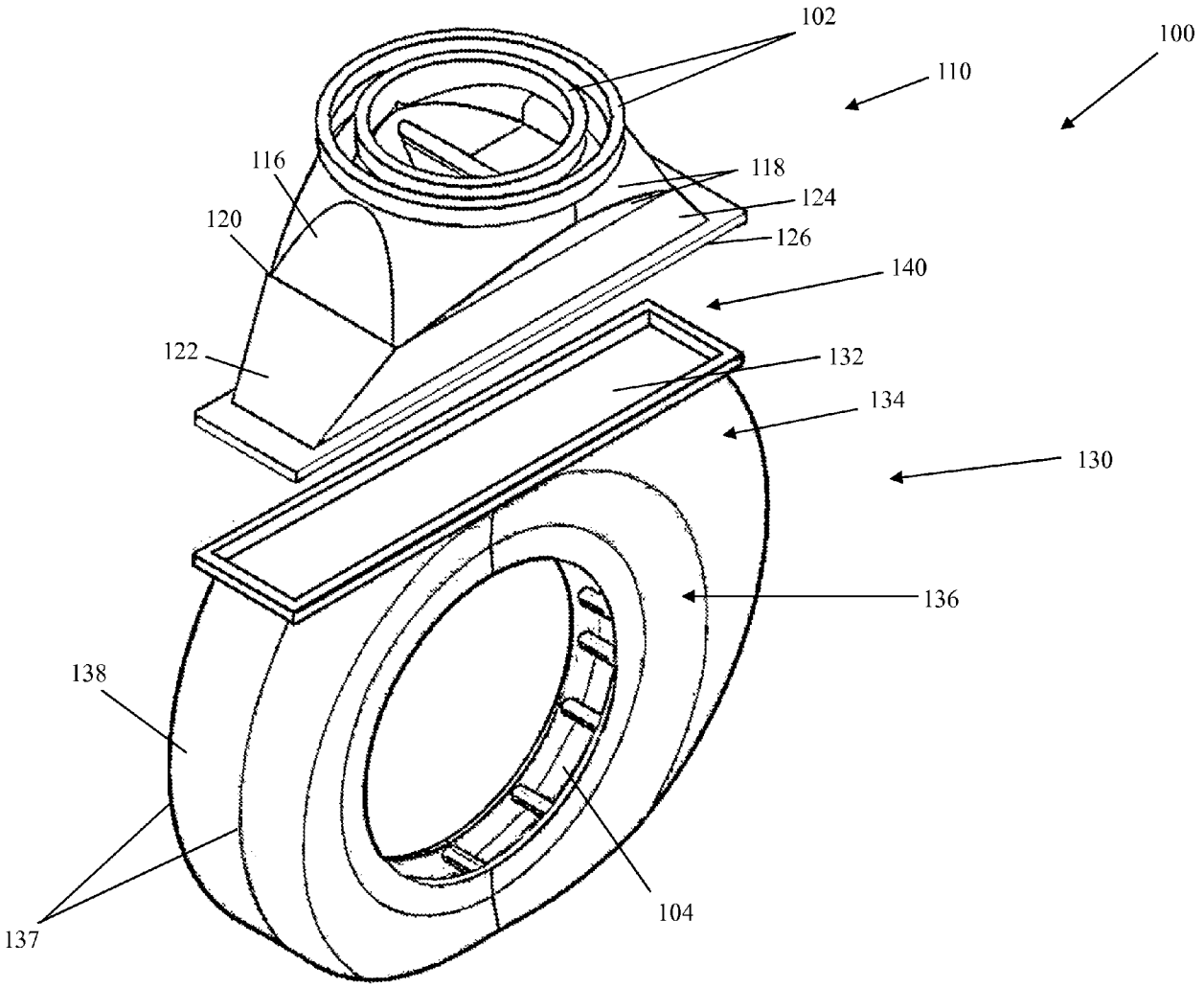
FIG. 3 shows a schematic elevation diagram of the example shown in FIG. 2 with portions of the inlet assembly separated according to embodiments of the invention disclosed herein are used.

With particular reference to FIG. 3, inlet bowl 130 can include an entry 132 of substantially identical cross section and dimension as inlet transition section exit 126. Inlet bowl entry can be connected to inlet transition section exit 126, which, combined with inlet transition section 126, can be construed as a polygonal interface 140. In embodiments, the polygonal interface 140 can include additional elements, such as flanges, gaskets, adapters, or the like, to facilitate connection of inlet transition section exit 126 and inlet bowl entry 132. In embodiments, inlet bowl entry 132 is formed in an annular portion 134 of inlet bowl 130, while exit(s) 104 of inlet assembly 100 and inlet bowl 130 can be formed in a frustroconical portion 136 of inlet bowl 130. In particular, entry 132 can be formed in a chordic plane parallel to a longitudinal axis of inlet bowl 130. As used herein, "chordic plane" refers to a plane extending through parallel chords of substantially identical dimension and location on opposite ends 137 of annular portion 134. Fluid thus can enter inlet bowl 130 perpendicular to the longitudinal axis of inlet bowl 130 and/or centerline CL (seen in FIG. 1) and can be redirected by inlet bowl 130 to exit inlet bowl 130 in another direction, such as parallel to the longitudinal axis of inlet bowl 130 and/or centerline CL.

Where inlet bowl 130 includes an annular portion 134, entry 132 can have a substantially polygonal cross section. Inlet transition section exit 126, therefore, can have a cross section matching that of entry 132, so that both can be polygonal or substantially polygonal, as can a cross section of inlet transition section 110 at intermediate region 120. While the cross sections of inlet transition section exit 126 and inlet bowl entry 132, as well as elements of polygonal interface 140 as may be employed, will have substantially identical dimensions, the cross section of intermediate region 120 can have different dimensions, as will be explained in more detail below.

Embodiments contemplate the provision of multiple sizes of inlet transition sections 110 that can be used with a single size of inlet bowl 130 to accommodate supply conduits of various diameters, as suggested in FIGS. 2-5. In other words, in a plurality of inlet transition sections 110 having entries or inlets 102 of at least two diameters, any inlet transition section 110 with an inlet 102 of diameter D within a range of diameters can be used with a particular size of inlet bowl entry 132. For example, if $D_1$ is a minimum inlet diameter and $D_2$ is a maximum inlet diameter, inlet transition regions of both diameters and for any diameter therebetween can be provided that will terminate in exits of substantially identical dimension. To simplify provision of such a range of sizes, embodiments contemplate direct or geometric scaling of reshaping portion 112. Thus, dimensions of substantially all parts of reshaping portion 112 increase and/or decrease by a same proportion as between two sizes of inlet transition section 110, but substantially all parts retain the same orientation(s) relative to each other for all inlet transition sections in the range of sizes. Each reshaping section 112 can therefore be viewed as a geometric scale of every other reshaping portion 112 in the plurality of inlet transition sections 110.

Since a larger diameter inlet transition section 110 will have a reshaping portion 112 of greater height than a smaller diameter inlet transition section 110, geometry of prismoidal portion 114 can be varied to provide a suitable conduit between a given reshaping portion 112 and inlet bowl 130, as will be explained below. This allows a single reshaping portion 112 design or arrangement to be used in the range of sizes, which can reduce design time and cost.

Figure 4:
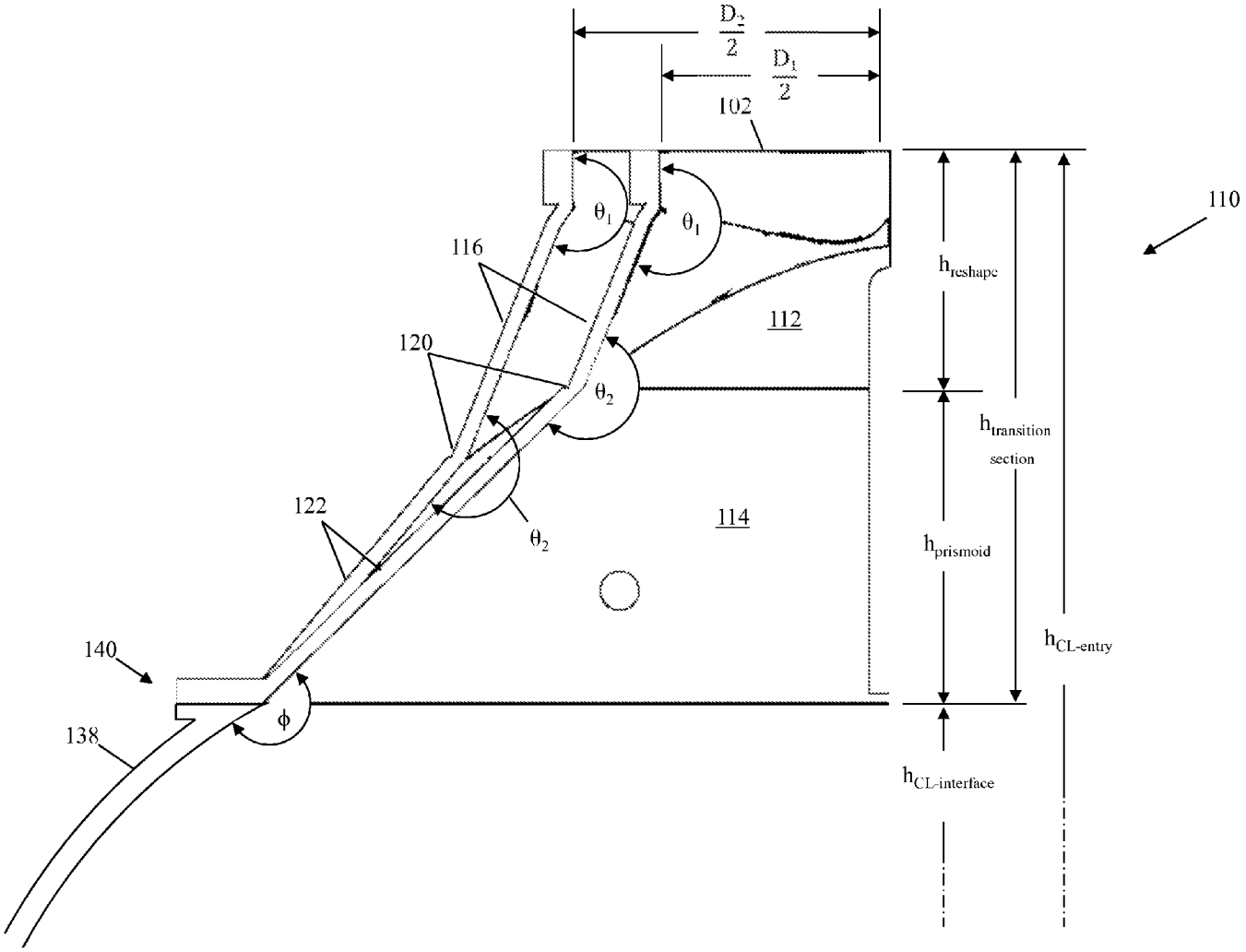
FIG. 4 shows a schematic cross sectional diagram of two examples of portions of inlet assemblies taken along line 4-4 in FIG. 2 according to embodiments of the invention disclosed herein.

With reference to FIG. 4, an inlet transition section 110 with an entry 102 of diameter $D_1$ can have a first angle $\theta_1$ between entry 102 and reshaping portion end walls 116, and a second angle $\theta_2$ between end walls 116 and prismoidal portion end walls 122 at intermediate region 120. According to embodiments, inlet transition section 110 with a different diameter $D_2$ can be used with the same inlet bowl by scaling reshaping portion 112, in which first $\theta_1$ is kept constant. As a result, end walls 116 have the same orientation for all diameters in a given range of inlet transition section sizes, as seen in FIG. 4 where end walls 116 are substantially parallel. However, a height $h_{reshape}$ of reshaping portion 112 can be unique to each diameter D of inlet 102, so that if diameter $D_2$ is different from diameter $D_1$, $h_{reshape}$ will also be different, and second angle $\theta_2$ must be changed to connect reshaping portion 112 to an inlet bowl 130 of the same size. By changing second angle $\theta_2$, an angle $\phi$ between each end wall 122 and outer wall 138 is also changed. In embodiments, end walls 122 of prismoidal portion 114 can meet an outer wall 138 of inlet bowl annular portion 134 substantially tangentially, as seen in FIG. 4 so that angle $\phi$ can be substantially 180°. However, to accommodate and/or provide inlet transition sections 110 of various sizes for a given inlet bowl size, angle $\phi$ can be less than or greater than 180°. To minimize losses in a flow through inlet assembly 100, embodiments can impose limits on angle $\phi$ for a given installation and/or inlet bowl size, which may affect a range of inlet transition section sizes that can be provided. Any such limits can be derived using thermodynamic and/or fluid dynamic and/or physical principles known to those skilled in the art and can take into account additional factors, such as height $h_{transition\ section}$ of inlet transition section 110, height $h_{reshape}$ of reshaping portion 112, height $h_{prismoid}$ of prismoidal portion 114, and/or dimensions of the polygonal cross section used for inlet bowl entry 132 and/or inlet transition section exit 126, though other factors and/or dimensions of inlet assembly 100 may be determined and/or considered as desired and/or appropriate.

Figure 5:
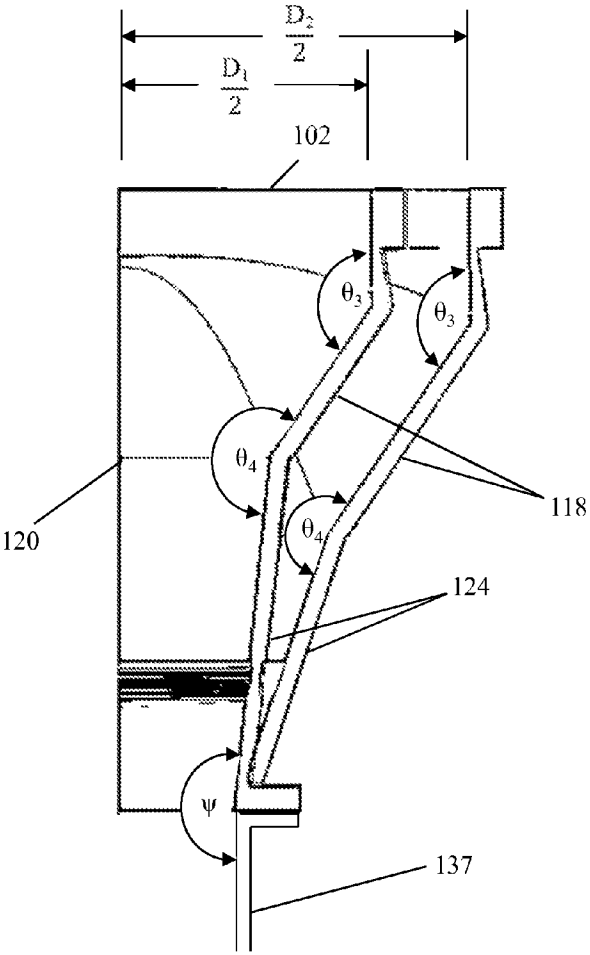
FIG. 5 shows a schematic cross sectional diagram of two examples of portions of inlet assemblies taken along line 5-5 in FIG. 2 according to embodiments of the invention disclosed herein.

As seen in FIG. 5, scaling reshaping section 112 as described above can affect additional relationships between elements of inlet transition section 112. For example, a third angle $\theta_3$ between entry 102 and side walls 118 can be kept substantially the same for all diameters within a range of inlet transition section sizes. However, a fourth angle $\theta_4$ will be varied accordingly to connect reshaping section 112 to an inlet bowl 130 of a given size. As a result, an additional angle $\psi$ between prismoidal portion side walls 124 and inlet bowl annular portion end walls 137 will also vary. It should be noted that a given reshaping geometry scaling can be based on maintaining either first angle or third angle constant in a range of sizes. Similarly, it should also be noted that limits can be imposed on additional angle $\psi$ in similar fashion to any that might be imposed on angle $\phi$.

The examples described above can be representative of a system and method of standardizing turbomachine inlet assemblies. For example, FIGS. 4 and 5 show two inlets simultaneously, one having a smaller entry 102 than the other, yet both meeting the same polygonal cross section at inlet transition section exits 126. Thus, as described above, a single size and configuration of polygonal interface 140 can be used with a plurality of sizes of inlet transition sections 110, or at least with inlet transition sections 110 having a plurality of entry diameters, thus enabling a single polygonal interface 140 to connect a single design of inlet bowl 130 with a plurality of sizes of inlet transition sections 110. In addition, additional ranges or pluralities of sizes of inlet transition sections 110 could be provided for additional inlet bowl sizes, a respective range for each inlet bowl size or design. Further, a single interface size can be used on a range of inlet bowl sizes by maintaining a thickness of inlet bowl annular portion 134 substantially constant for a range of sizes of inlet bowl 130, which can allow a single polygonal interface 140 to be applied by moving inlet bowl entry 132 toward or away from the longitudinal axis and/or centerline CL of inlet bowl 130. Embodiments thus contemplate a plurality of polygonal interface sizes combined with a plurality of sizes of inlet transition section 110 and inlet bowl 130 that can accommodate a wide variety of turbomachine installations while reducing a design and inventory burden.

Figure 6:
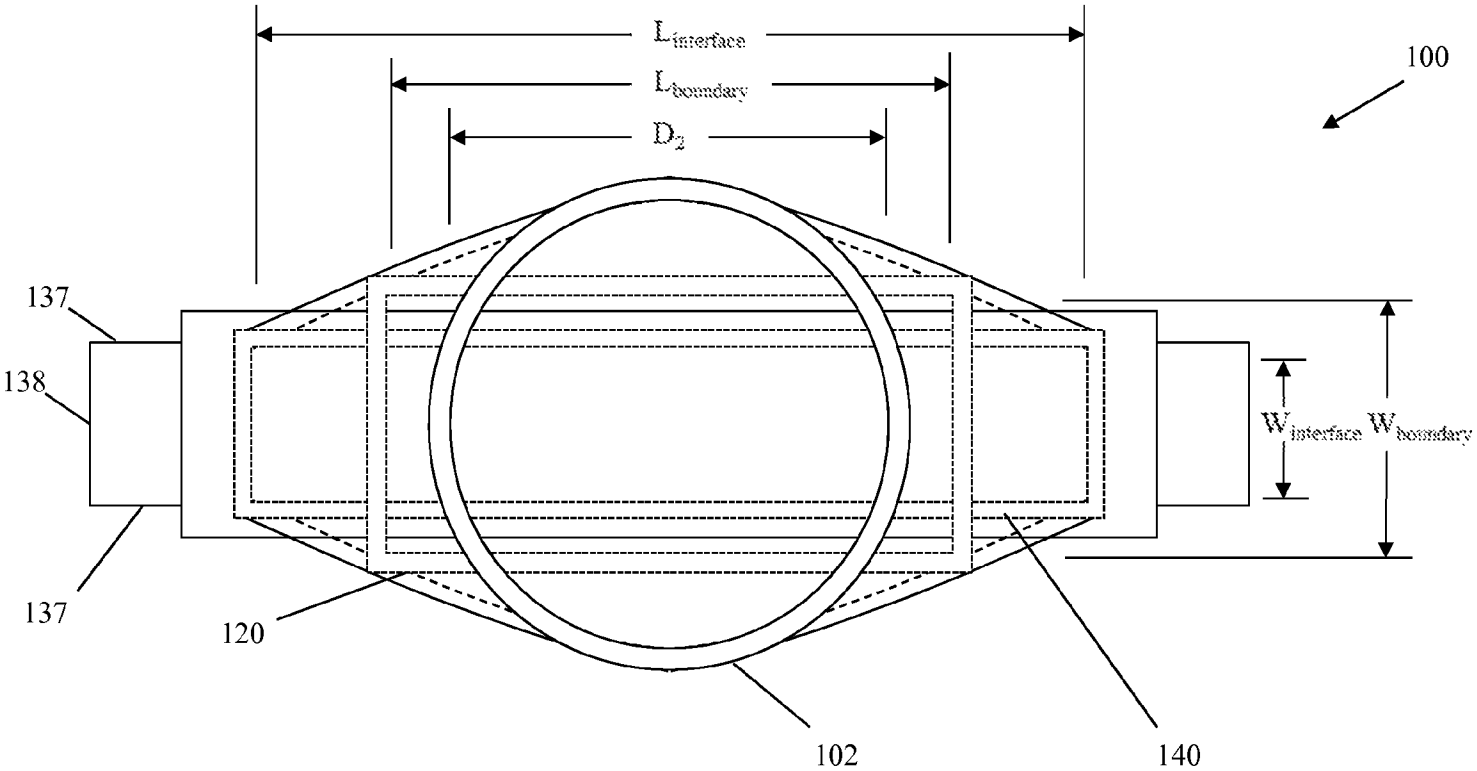
FIG. 6 is a schematic top view of an example of an inlet assembly highlighting cross sections at an entry, intermediate region or boundary, and exit of an inlet transition section according to embodiments of the invention disclosed herein.

As described above, and with reference to FIG. 6, inlet transition section reshaping portion 112 can change in cross section from circular to polygonal or substantially polygonal, and prismoidal portion 114 can change dimension(s) of the cross section to fit interface 140. For the sake of convenience in describing embodiments of the invention, the example of a polygonal cross section shown in the FIGS. is rectangular, but it should be understood that this is not limiting and that any polygon could be used as appropriate and/or desired. In addition to the change in cross section in reshaping portion 112, a cross sectional area $A_{transition\ section}$ can be substantially constant through reshaping portion 112. Thus, an entry 102 of diameter $D_2$ can have an area of $\pi/4D_2^2$, and a polygonal or substantially polygonal cross section at intermediate region 120, which can also be viewed as a boundary, can be sized so that its area ($W_{boundary} \times L_{boundary}$ for the rectangular example shown) is equal to $\pi/4D_2^2$, or at least as close as is feasible. As also seen in FIG. 6, the dimensions of the polygonal cross section at intermediate region or boundary 120 and those of interface 140 can be different, though the polygon used can be the same. Thus, $W_{boundary} \neq W_{interface}$ in the example shown, and $L_{boundary} \neq L_{interface}$, but the cross section in the example is rectangular at both locations. An aspect ratio of the cross section can be useful in embodiments, and typically the aspect ratio at intermediate region 120 will be closer to a value of 1 than the aspect ratio at interface 140 since the cross section at intermediate region 120 has substantially the same area as that of the circular cross section of entry 102. In embodiments, constraints may be placed on the aspect ratio as a function of transition angles between inlet transition section 110 and entry 102, transition angles between inlet transition section 110 and inlet bowl outer wall 138, flow properties, and/or other factors as may be suitable and/or desired.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A turbomachine inlet transition section comprising:

a reshaping portion having a circular entry and an intermediate region, the reshaping portion beginning at the circular entry and ending at the intermediate region, wherein the intermediate region includes a first polygonal cross section, and wherein a cross section of the reshaping portion changes from circular at the entry to the first polygonal cross section at the intermediate region while maintaining constant cross sectional area throughout the reshaping portion; and a prismoidal portion having an inlet transition section exit, the prismoidal portion beginning at the intermediate region and ending at the inlet transition section exit, wherein the inlet transition section exit includes a second polygonal cross section, and wherein a cross section of the prismoidal portion changes from the first polygonal cross section to the second polygonal cross section, the first and second polygonal cross sections being of the same type of polygon while being of different dimension, and wherein an aspect ratio of the first polygonal cross section is closer to one than an aspect ratio of the second polygonal cross section.

2. The inlet transition section of claim 1, wherein the first and second polygonal cross sections are rectangular, the reshaping portion includes opposed end walls and opposed side walls at the intermediate region, the prismoidal portion includes opposed end walls and opposed side walls, the opposed end walls of the reshaping and prismoidal portions meet at a first angle in the intermediate region, and the opposed side walls of the reshaping and prismoidal portions meet at a second angle in the intermediate region.

3. The inlet transition section of claim 1, wherein the inlet transition section includes an alternate inlet transition section, an entry of the alternate inlet transition section having a different diameter than the circular entry, and the alternate inlet transition section having an exit that is of identical dimension to the inlet transition section exit.

4. The inlet transition section of claim 3, wherein each reshaping portion includes a first angle between a respective entry and a respective wall of the respective reshaping portion, and the first angle is of equal value for all of the first plurality of inlet transition sections.

5. The inlet transition section of claim 3, wherein each exit of the first plurality of inlet sections is of a first size configured for connection to at least one inlet bowl each including a respective exit of the first size, and each exit of the second plurality of inlet transition sections is configured for connection to at least one inlet bowl each including an entry of the second size.

6. A modular turbomachine inlet assembly system comprising:

a first plurality of inlet transition sections, the plurality of inlet sections having identical exits of a first size, each inlet transition section including an entry, the entries of the first plurality of inlet transition sections being of at least two different sizes, each inlet transition section including a reshaping portion, and each inlet transition section including a prismoidal portion having an intermediate region sized to mate to the respective reshaping portion such that the prismoidal portion extends from the intermediate region to the exit, wherein each reshaping portion includes a first angle between the respective entry and a respective reshaping portion wall, the first angle of each reshaping portion being equal to the first angle of every other reshaping portion in the first plurality of inlet transition sections; and at least one inlet bowl including an entry of the first size configured for connection to an exit of an inlet transition section of the first plurality of inlet transition sections.

7. The system of claim 6, wherein a cross section of the inlet transition section entry includes a first shape, a cross section of the intermediate region includes a second shape, and a cross sectional area of the reshaping portion being constant throughout an interior of the reshaping portion, the first shape and the second shape being of different types.

8. The system of claim 7, wherein the first shape is a circle and the second shape is a polygon.

9. The system of claim 7, wherein the prismoidal portion includes a cross section of the second shape at the intermediate region and a cross section of a third shape at the inlet transition section exit, the second shape and the first shape being a same type of shape and differing in at least one dimension.

10. The system of claim 6, wherein the inlet transition section is one of a second plurality of inlet transition sections, the second plurality of inlet transition sections having exits of a second size that differs in at least one dimension from the first size.

11. The system of claim 10, wherein the at least one inlet bowl includes an inlet bowl with an entry of the second size.

12. A modular turbomachine inlet assembly system comprising:

at least two inlet transition sections, each inlet transition section including:

a respective circular entry, a respective polygonal intermediate region, and a respective polygonal exit, wherein the at least two inlet transition sections include entries of at least two different diameters, wherein the polygonal exits of the at least two inlet transition sections include identical dimensions;

a reshaping portion extending between each circular entry and the respective polygonal intermediate portion, wherein a cross sectional area of the reshaping portion is constant from each circular entry to the respective polygonal intermediate region;

a prismoidal portion extending between each polygonal intermediate region and the respective polygonal exit; and at least one inlet bowl having a polygonal entry of identical dimension to the polygonal exits of the at least two inlet transition sections, each inlet bowl polygonal entry corresponding to and configured for attachment to one of the at least two inlet transition sections.

13. The modular turbomachine inlet assembly system of claim 12, wherein the prismoidal portion includes a first polygonal cross section at the intermediate region, and the inlet bowl polygonal entry having a second polygonal cross section differing from the first polygonal cross section in at least one dimension.

14. The modular turbomachine inlet assembly system of claim 12, wherein, in an interior of an inlet transition section and a corresponding inlet bowl entry, all angles formed by a part of the inlet assembly meeting another part of the inlet assembly along a direction of flow fall in a range determined at least in part using expected flow conditions and at least one of a diameter of the inlet transition section entry or a dimension of the inlet bowl entry.

15. A turbomachine inlet transition section comprising:

a reshaping portion having a round entry and an intermediate region, the reshaping portion beginning at the round entry and ending at the intermediate region, wherein the intermediate region includes a first polygonal cross section, and wherein a cross section of the reshaping portion changes from round at the entry to the first polygonal cross section at the intermediate region while maintaining constant cross sectional area throughout the reshaping portion; and a prismoidal portion having an inlet transition section exit, the prismoidal portion extending between the intermediate region and the inlet transition section exit such that the prismoidal portion tapers in a first dimension and expands in a second dimension, wherein the inlet transition section exit includes a second polygonal cross section, and wherein a cross section of the prismoidal portion changes from the first cross section to the second polygonal cross section, the first and second polygonal cross sections being of the same type of polygon while being of different dimension.

* * * * *